United States Patent [19]

Mieno et al.

[11] Patent Number: 4,721,088

[45] Date of Patent: Jan. 26, 1988

[54] METHOD FOR CONTROLLING AN OXYGEN CONCENTRATION DETECTION APPARATUS WITH A HEATER ELEMENT

[75] Inventors: Toshiyuki Mieno; Toyohei Nakajima; Yasushi Okada; Nobuyuki Oono, all of Wako, Japan

[73] Assignee: Honda Giken Kogyo Kabushiki Kaisha, Tokyo, Japan

[21] Appl. No.: 936,427

[22] Filed: Dec. 1, 1986

[30] Foreign Application Priority Data

Nov. 29, 1985 [JP] Japan ..... 60-269095

[51] Int. Cl.[4] ..... F02M 51/00; F02M 7/00

[52] U.S. Cl. ..... 123/489; 123/440

[58] Field of Search ..... 123/489, 440, 480, 491, 123/589; 204/14, 406, 412, 425, 426

[56] References Cited

U.S. PATENT DOCUMENTS 4,011,562 9/1986 Nakano et al. ..... 123/489
4,543,176 9/1985 Harada et al. ..... 123/489
4,601,809 7/1986 Kitahara ..... 123/489
4,628,883 12/1986 Kataoka ..... 123/489
4,644,921 2/1987 Kobayashi et al. ..... 123/489
4,655,182 4/1987 Nakano et al. ..... 123/489

*Primary Examiner*—Raymond A. Nelli

*Attorney, Agent, or Firm*—Pollock, Vande Sande and Priddy

[57] ABSTRACT

A method for controlling an oxygen concentration detection apparatus mounted on an engine, including an oxygen concentration sensing element and a heater element for heating the oxygen concentration sensing unit, includes an operation for detecting an engine temperature of a time immediately before the start of the supply of a drive current to the heater element, and an operation for controlling the magnitude of the drive current for a time period which is determined correspondingly to the engine temperature, to be lower than a level of the drive current to be supplied to the heater element after the elapse of the time period determined according to the engine temperature.

2 Claims, 10 Drawing Figures

METHOD FOR CONTROLLING AN OXYGEN CONCENTRATION DETECTION APPARATUS WITH A HEATER ELEMENT

BACKGROUND OF THE INVENTION

1. Field of the Invention

The present invention relates to a method for controlling an oxygen concentration detection apparatus, and more specifically to a method for controlling the supply of heater current to a heater element provided in the oxygen concentration detection apparatus.

1 Description of Background Information

In order to accelerate the purification of the exhaust gas and to improve the fuel economy of an internal combustion engine, a feedback type air/fuel ratio control system is generally used, in which oxygen concentration in the exhaust gas is detected and air/fuel ratio of the mixture supplied to the engine is controlled to a target air/fuel ratio by a feedback control operation in accordance with a result of the detection of the oxygen concentration.

As an oxygen concentration detection apparatus for use in such an air/fuel ratio control system, there is a type which is capable of producing an output signal whose level is proportional to the oxygen concentration in the exhaust gas of the engine in a region in which the air/fuel ratio of the mixture is larger than a stoichiometric air/fuel ratio, and the detail of which is disclosed in Japanese patent application laid open No. 58-153155. This oxygen concentration detection apparatus includes an oxygen concentration sensing unit having a general construction including a pair of flat solid electrolyte members having oxygen ion permeability. These oxygen ion conductive solid electrolyte members are placed in the exhaust gas of the engine, and electrodes are respectively provided on the front and back surfaces of both of the solid elctrolyte members. In other words, each pair of electrodes sandwich each solid electrolyte member. These two solid electrolyte members each having a pair of electrodes are arranged in parallel so as to face each other and forming a gap portion, or in other words, a restricted region between them.

With this arrangement, one of the solid electrolyte members serves as an oxygen pump element and the other one of the solid electrolyte members serves as a sensor cell element for sensing an oxygen concentration ratio. In an ambient atmosphere of the exhaust gas, a drive current is supplied across the electrodes of the oxygen pump element in such a manner that the electrodes facing the gap portion operates as a negative electrode. By the supply of this current, i.e. a pump current, the oxygen component of the gas in the gap portion is ionized on the surface of the negative electrode of the oxygen pump element. The oxygen ions migrate through the inside of the oxygen pump element to the positive electrode, where the oxygen ions are released from the surface thereof in the form of the oxygen gas.

While this movement of the oxygen ions is taking place, the oxygen concentration becomes different for the gas in the gap portion and the gas outside the sensor cell element because of a decrease of the oxygen gas component in the gap portion. Therefore, a voltage whose magnitude varies substantially linearly in proportion to the oxygen concentration of the gas to be measured is generated across the electrodes of the solid electrolyte member operating as the sensor cell element, if the magnitude of the electric current supplied to the oxygen pump element, i.e the pump current, is constant.

By means of this voltage generated across the electrodes of the sensor cell element, a detection as to whether the air/fuel ratio of the mixture supplied to the engine is rich or lean is performed. In the case of the air/fuel ratio control system in which the air/fuel ratio is controlled by the supply of the air intake side secondary air, the secondary air is supplied when the air/fuel ratio is detected to be rich. On the other hand, the supply of the secondary air is stopped when the air/fuel ratio is detected to be lean, and the air/fuel ratio is controlled toward a target air/fuel ratio by the supply and stop of the air intake side secondary air. Further, if the magnitude of the pump current supplied to the oxygen pump element is varied so that the voltage developing across the electrodes of the sensor cell element becomes constant, the magnitude of the pump current varies substantially in proportion to the oxygen concentration in the exhaust gas, under a condition of a constant temperature.

In this type of the oxygen concentration sensing unit, it is necessary that the temperature of the sensing unit is sufficiently high. Especially in the case of the above mentioned proportional type oxygen concentration sensing unit, its operating temperature must be higher (for example, higher than 650° C.) than an exhaust gas temperature under a steady state operation, in order to obtain a proportional output signal characterisic in which the sensor output signal varies substantially in proportion to the oxygen concentration. To meet this requirement, a heater element which is made up of a heater wire, for example, is incorporated in the oxygen concentration sensing unit and a drive current is started to be supplied to the heater element upon starting of the engine operation so that heat is generated at the heater element.

As the heater element, it is general to use a material having a positive resistance temperature coefficient, such as a nickel-chromium wire. This means that, upon cold start of the engine, the internal resistance of the heater element is smaller than the value under a hot start of the engine. Therefore, when the supply of the heater current is started when the engine is cold, an excessive rush current flows through the heater element as typically illustrated in FIG. 1. By this excessive current, a rapid deterioration of the heater element or a wire break in the heater element is induced. Thus, there has been a problem that the longevity of the heater element is rather short. Further, it has been possible that a breakdown of the oxygen concentration detection unit occurs due to its rapid temperature rise immediately after the start of the supply of the heater current.

SUMMARY OF THE INVENTION

An object of the present invention is to provide a method for controlling an oxygen concentration detection device by which the chance of the breakdown of the oxygen concentration detection unit is reduced, and the longevity of the oxygen concentration detection apparatus can be extended.

According to the present invention, a method for controlling an oxygen concentration detection apparatus includes an operation for detecting an engine temperature immediately before the start of the supply of the heater current, and operative to reduce the magnitude of the heater current during a time period from the start of the supply of the heater current to a time at which a time period corresponding to a detected engine temperature has passed, than a value of the heater current after the elapse of the time period corresponding to the detected engine temperature.

DETAILED DESCRIPTION OF THE PREFERRED EMBODIMENT

Figure 1:
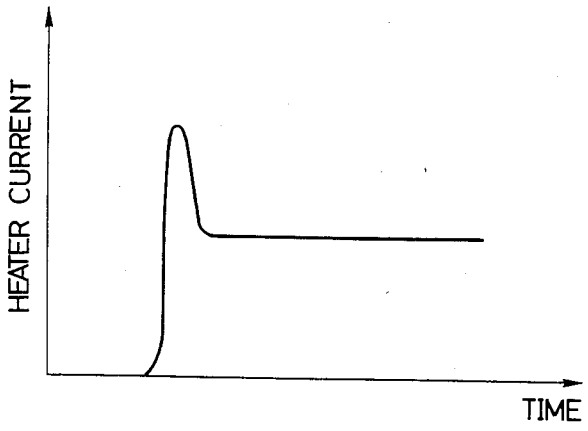
FIG. 1 is a diagram showing a characteristic of a heater current after the start of current supply in a conventional arrangement.
Figure 2:
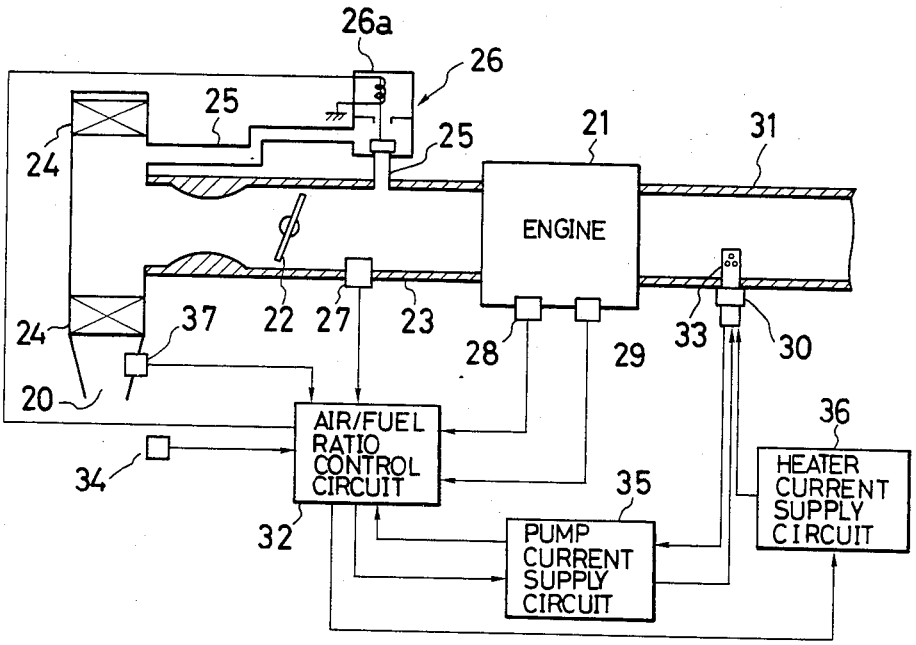
FIG. 2 is a diagram schematically showing the construction of an air/fuel ratio cotnrol system in which the control method according to the present invention is adopted.

FIG. 2 exemplarily shows an air/fuel ratio control system for an automotive internal combustion engine in which the method for controlling an oxygen concentration detection apparatus according to the present invention is adopted.

As shown, an internal combustion engine which is generally denoted by the reference numeral 21 has a throttle valve 22 and an intake manifold 23. The intake manifold 23 which is downstream of a throttle valve 22 communicates with an inside of an air clearner 24, near an air outlet port thereof, via an air intake side secondary air supply passage 25. An open-close solenoid valve 26 is provided in the secondary air supply passage 25, and arranged to open when a drive current is supplied to its solenoid 26*a*.

The intake manifold 23 is provided with an absolute pressure sensor 27 which produces an output signal whose level is responsive to an absolute pressure in the intake manifold 23. In addition to this absolute pressure sensor 27, the air/fuel ratio control system includes various sensors such as a rotational speed sensor 28 which produces an output signal whose level is responsive to a rotation of a crankshaft (not shown) of the engine 21, and a cooling water temperature sensor 29 for producing an output signal whose level represents the temperature of the cooling water of the engine 21. The reference numeral 37 denotes an intake air temperature sensor provided on the air clearner 24 near its air inlet port 20, and the reference numeral 30 denotes an oxygen concentration sensing unit of the oxygen concentration detection apparatus which produces an output signal varying substantially in proportion to an oxygen concentration in the exhaust gas, and mounted on an exhaust manifold 31 of the engine 21. The open-close solenoid valve 26, the absolute pressure sensor 27, the rotational speed sensor 28, the cooling water temperature sensor 29 and the intake air temperature sensor 37 are connected to an air/fuel ratio control circuit 32 in which a microcomputer is provided. An ignition switch 34 is also connected to this air/fuel ratio control circuit 32 so that an output voltage of a battery (not shown) mounted on the vehicle is supplied thereto.

The oxygen concentration sensor part includes a pump current supply circuit 35 which supplies a pump current to the oxygen pump element of the oxygen concentration sensor 30 and a heater current supply circuit 36 for supplying a heater current to the heater element of the oxygen concentration sensor 30. The pump current generating circuit 35 and the heater current supply circuit 36 are also connected to the air/fuel ratio control circuit 32.

Figure 3:
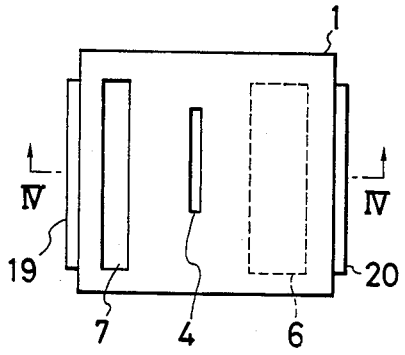
FIG. 3 is a plan view of an oxygen concentration sensing unit used in the system shown in FIG. 2.
Figure 4:
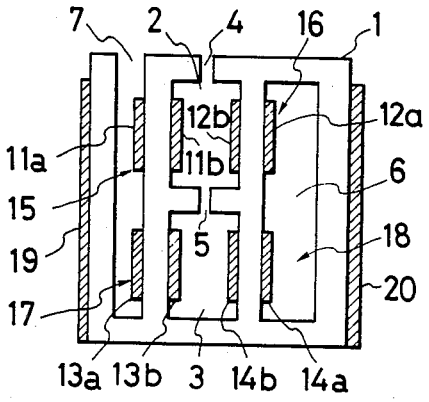
FIG. 4 is a sectional side view of the oxygen concentration sensint unit taken along the line IV—IV of FIG. 3.

As shown in FIGS. 3 and 4, the oxygen concentration sensor 30 has a protection case 33 in which an oxygen ion conductive solid electrolyte member 1 having generally cubic configuration is provided. In the oxygen ion conductive solid electrolyte member 1, first and second gas retaining chambers 2 and 3, which constitute gap portions, are provided. The first gas retaining chamber 2 leads to a gas introduction port 4 for introducing the measuring gas, i.e. the exhaust gas of the engine, from outside of the oxygen ion conductive solid electrolyte member 1. The gas introduction port 4 is positioned in an exhaust gas passage (not shown) of the internal combustion engine so that the exhaust gas can easily flow into the gas retaining chamber 2. In a wall between the first gas retaining chamber 2 and the second gas retaining chamber 3, there is provided a communication channel 5 so that the exhaust gas is introduced into the second gas retaining chamber 3 through the gas introduction port 4, the first gas retaining chamber 2 and the communication channel 5. Further, the oxygen-ion conductive solid electrolyte member 1 is provided with a reference gas chamber 6 into which outside air, for example, is introduced. The reference gas chamber 6 is provided in such a manner that it is separated from the first and second gas retaining chambers 2 and 3 by means of a partition wall between them. In a side wall of the first and second gas retaining chambers 2 and 3, on the opposite side of the reference gas chamber 6, there is provided an electrode protection cavity 7. The wall between the first gas retaining chamber 2 and the reference gas chamber 6 and the electrode protection cavity 7, there respectively are provided a pair of electrodes 12*a* and 12*b*, and a pair of electrodes 11*a* and 11*b*. The electrodes 11*a*, 11*b*, and 12*a*, 12*b* form a first set of electrodes associated with the first gas retaining chamber 2. Similarly, the wall between the second gas retaining chamber 3 and the gas reference chamber 6, and the wall between the second gas retaining chamber 3 and the electrode protection cavity 7 are respectively provided with a pair of electrodes 14*a* and 14*b*, and a pair of electrodes 13*a* and 13*b*. The electrodes 13*a*, 13*b*, and 14*a*, 14*b* form a second set of electrodes associated with the second gas retaining chamber 3. With this construction, the solid electrolyte member 1 and the pair of electrodes 11*a* and 11*b* together operate as a first oxygen pump unit 15. On the other hand, the solid electrolyte member 1 and the pair of electrodes 12*a* and 12*b* together operate as the first sensor cell unit 16. Similarly, the solid electrolyte member 1 and the pair of electrodes 13*a* and 13*b* together operate as a second oxygen pump unit 17, and the solid electrolyte member 1 and the pair of electrodes 14*a* and 14*b* together operate as the second sensor cell unit 18. Further, heater elements 19 and 20 are respectively provided on an outer wall of the reference gas chamber 6 and an outer wall of the electrode protection cavity 7, respectively. The heater elements 19 and 20 are electrically connected in parallel with each other so as to heat the first and second oxygen pump units 15 and 17, and the first and second sensor cell units 16 and 18 equally. The heater elements 19 and 20 further has an effect to enhance the heat retaining property of the solid electrolyte member 1. The solid electrolyte member 1 is made up of a plurality of pieces, to form an integral member. In addition, the walls of the first and second gas retaining chambers 2 and 3 need not be made of the oxygen ion conductive solid electrolyte as a whole. At least portions of the wall on which the electrodes are provided must be made of the solid electrolyte.

As the oxygen ion conductive solid electrolyte, zirconium dioxide ($ZrO_2$) is suitably used, and platinium (Pt) is used as the electrodes 11*a* through 14*b*.

The first oxygen pump unit 15 and and the first sensor cell unit 16 form a first sensor, and the second oxygen pump unit 17 and the second sensor cell unit 18 form a second sensor. The first and second oxygen pump units 15 and 17, the first and second sensor cell units 16 and 18 are connected to a pump current supply circuit 35. In accordance with a selection command from the air/fuel ratio control circuit 32, the pump current supply circuit 35 supplies the pump current to either one of the first and second oxygen pump units 16 and 18, and the air/fuel ratio control circuit 32 selects one of the sensor cell units 16 and 18 corresponding to the one of the oxygen pump units to which the pump current is supplied.

To the heater elements 19 and 20, currents are supplied from a heater current supply circuit 36 so that the heater elements 19 and 20 are driven to heat the oxygen pump units 15 and 17, and the sensor cell units 16 and 18 to a suitable temperature level which is higher than the temperature of the exhaust gas.

With this construction, the exhaust gas in the exhaust pipe flows in to the first gas retaining chamber 2 through the gas intorduction port 4, and is diffused therein. Also, the exhaust gas entered in the first gas retaining chamber 2 is introduced into the second gas retaining chamber 3 through the communication channel 5 and is diffused therein.

Under a condition where the first sensor is selected, the pump current flows from the electrode 11*a* to the electrode 11*b* when the air/fuel ratio of the mixture to be supplied to the engine is in a lean range. Therefore, oxygen in the first gas retaining chamber 2 is ionized at the electrode 11*b*, and moves through the inside of the oxygen pump unit 15 to the electrode 11*a*. At the electrode 11*a*, the oxygen is released in the form of oxygen gas. In this way, oxygen in the first gas retaining chamber 2 is pumped out. By the pumping out of oxygen in the first gas retaining chamber 2, a difference in the oxygen concentration develops between the exhaust gas in the first gas retaining chamber 2 and a gas in the reference gas chamber 6. By this difference in the oxygen concentration, a voltage $V_s$ is generated across the electrodes 12*a* and 12*b* of the sensor cell unit 16. Since the magnitude of the pump current is controlled by the pump current supply circuit so that the voltage $V_s$ becomes equal to a reference voltage Vr1, the magnitude of the pump current becomes proportional to the oxygen concentration in the exhaust gas.

When the air/fuel ratio of the mixture is in a rich range, the voltage $V_s$ exceeds the reference voltage $Vr_1$. Terefore, the pump current is controlled to flow from the electrode 11*b* to the electrode 11*a*, so that oxygen in the outside is ionized at the electrode 11*a* and in turn moves through the inside of the first oxygen pump unit to the electrode 11*b*. At the electrode 11*b*, the oxygen is released, in the form of oxygen gas, into the first gas retaining chamber 2. In this way, the oxygen is pumped into the first gas retaining chamber 2. Therefore, if the pump current is supplied so that the oxygen concentration in the first gas retaining chamber 2 is maintainted constant, the oxygen is pumped in or out according to the direction of the pump current. Thus, the magnitude of the pump current becomes proportional to the oxygen concentration in the exhaust gas in both of the lean and rich ranges.

The pump current is expressed by the following equation (1) in which the pump current is denoted by $I_p$.

$$I_p = 4e\sigma o\ (Poexh - Pov) \quad (1)$$

in which e represents the electric charge, $\sigma o$ represents the diffusion coefficient of the gas introduction port 4 against the exhaust gas, Poexh represents the oxygen concentration of the exhaust gas, and Pov represents the oxygen concentration in the first gas retaining chamber 2.

The diffusion coefficient $\sigma o$ can be expressed by the following equation:

$$\sigma o = D\ A/ktl \quad (2)$$

where A represents the sectional area of the gas introduction port 4, k represents boltzmann's constant, T represents absolute temperature, l represents the length of the gas introduction port 4, and D represents a diffusion constant.

On the other hand, when the second sensor is selected, the pump current is supplied across the electrodes 13*a* and 13*b* of the second oxygen pump unit 17 so that the oxygen concentration in the second gas retaining chamber 3 is maintained constant by an operation the same as that in the state where the first sensor is selected. Therefore, the oxygen is pumped in or out by the pump current, and the magnitude of the pump current vary in proportion to the oxygen concentration in both of the lean and rich range. In the state in which the second sensor unit is selected, the magnitude of the pump current can be expressed by using the equation (1) with the diffusion coefficient $\nu o$ calculated for the gas introduction port 4 and the communication channel 5, and the oxygen concentration in the second gas retaining chamber 3 as the value Pov.

On the other hand, the air/fuel ratio control circuit 32 detects whether the air/fuel ratio of the mixture supplied to the engine is richer or leaner than the target air/fuel ratio by means of the magnitude of the pump current $I_p$ which is supplied from the pump current supply circuit 35 to one of the oxygen pump units 15 and 17 depending on the selection between the first and second sensors. More specifically, the air/fuel ratio control circuit 32 determines that the air/fuel ratio of the mixture is rich when the magnitude of the pump current $I_p$ is smaller than a reference value corresponding to the target air/fuel ratio and determined respectively for each sensor. Conversely, the air/fuel ratio control circuit 32 determines that the air/fuel ratio of the mixture is lean when the magnitude of the pump current is equal to or greater than the reference value. In accordance with a result of this detection, the air/fuel ratio control circuit 32 controls the opening and closing of the open-close solenoid valve 26 so that the air intake side secondary air is supplied into the intake manifold 23. The feedback control of the air/fuel ratio of the mixture supplied to the engine is performed in this way.

A duty ratio control of the supply of the heater current by means of the heater current supply circuit 36 is also performed by the air/fuel ratio control circuit 32. More specifically, the air/fuel ratio control circuit provides $I_H$ duty pulses which indicate the magnitude of the heater current $I_H$, to the heater current supply circuit at predetermined intervals. The heater current supply circuit 36 includes a switching transistor which receives the $I_H$ duty pulses and turns on to supply a battery voltage $V_B$ to the heater elements 19 and 20 upon receipt of the $I_H$ duty pulse. Thus, the heater current supply circuit 36 supplies the heater current whose magnitude is proportional to a duty ratio $D_{OUT}$ of the $I_H$ duty pulse to the heater elements 19 and 20.

Figure 5:
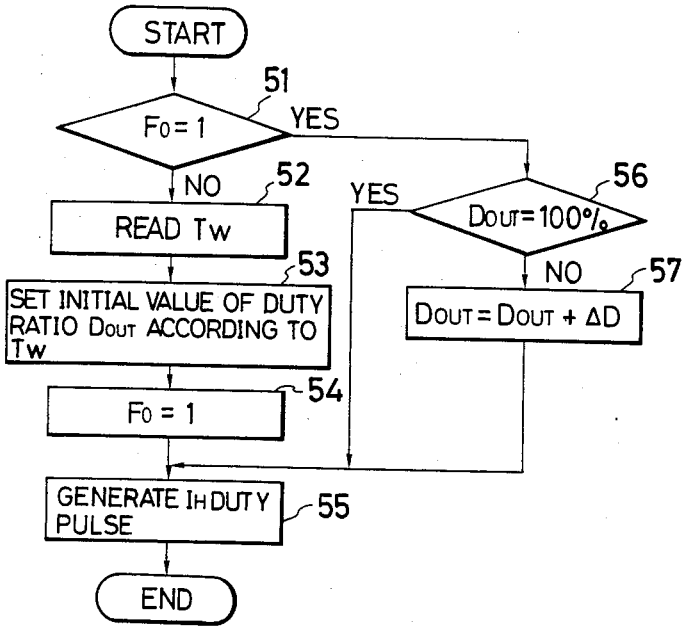
FIG. 5 is a flow chart showing the steps of an embodiment of the control method according to the present invention.

Referring to the flowchart of FIG. 5, explanation is further made to the steps for controlling the oxygen concentration detecting apparatus in accordance with the present invention which are performed by the air/fuel ratio control circuit 32.

When an ignition switch (not shown) is turned on, the air/fuel ratio control circuit 32 starts to detect whether or not an initial value set flag Fo is equal to "1" at predetermined intervals, at a step 51. Upon turning of the ignition switch 34, a value "0" is set for the initial value set flag Fo. If Fo=0, it means that an initial value of the duty ratio $D_{OUT}$ of the $I_H$ duty pulse is not set, and the cooling water temperature $T_W$ is read-in at a step 52 from an output signal of the cooling water temperature sensor 29. Then the initial value of the duty ratio $D_{OUT}$ of the $I_H$ duty pulse is set at a step 53 correspondingly to the read value of the cooling water temperature $T_W$.

In an internal memory of the air/fuel ratio control circuit 32, various values for the initial value of the duty ratio $D_{OUT}$ of the $I_H$ duty pulse, which are determined from the cooling water temperature $T_W$, are previously stored in the form of a data map. Therefore, the air/fuel ratio control circuit 32 searches a value of the initial value corresponding to a read value of the cooling water temperature $T_W$ from the data map. The initial value of the duty ratio $D_{OUT}$ of the $I_H$ duty pulse is determined to be greater as the cooling water temperature $T_W$ rises. After the set of the initial value of the duty ratio $D_{OUT}$ (initial duty ratio) of the $I_H$ duty pulse, a value "1" is set for the initial value set flag Fo, at a step 54. Then the air/fuel ratio control circuit 32 supplies to the heater current supply circuit 36 the $I_H$ duty pulse having the initial duty ratio $D_{OUT}$, at a step 55.

If it is detected, at the step 51, that Fo is equal to 1 (Fo=1), then whether or not the duty ratio $D_{OUT}$ is equal to 100% is detected at a step 56. If $D_{OUT} \neq 100\%$, an incremental value $\Delta D$ is added to the duty ratio $D_{OUT}$, and the duty ratio value obtained by the addition is set as a new duty ratio $D_{OUT}$ at a step 57. The $I_H$ duty pulse having the new duty ratio $D_{OUT}$ is supplied to the heater current supply circuit 36, at the step 55. If $D_{OUT}=100\%$, the $I_H$ duty pulse having the duty ratio of 100% is supplied to the heater current supply circuit at the step 55.

Figure 6:
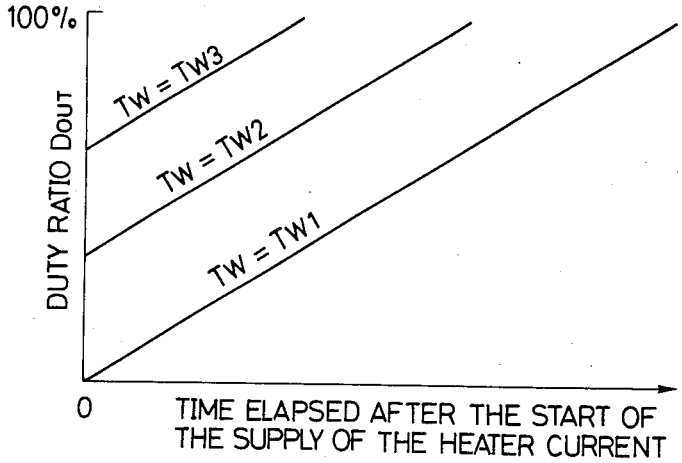
FIG. 6 is a diagram showing a variation of a duty ratio $D_{OUT}$ immediately after the start of the supply of the heater current.

Thus, in the control method of the oxygen concentration detecting apparatus according to the present invention, the duty ratio $D_{OUT}$ of of the $I_H$ duty pulse increases gradually from an initial value, which is determined correspondingly to the cooling water temperature $T_W$, to the value 100% after the closure of the ignition switch 34. In other words, magnitude of each of the heater currents flowing through the heater elements 19 and 20 is proportional to the duty ratio $D_{OUT}$, and the heater currents increase gradually during a time period within which the duty ratio $D_{OUT}$ increases from the initial value and reaches 100%. FIG. 6 exemplary illustrates variations of the heater current for different values of the cooling water temperature $T_W$. As shown, the higher the cooling water temperature $T_W$ is ($T_{W1}<T_{W2}<T_{W3}$), the greater the duty ratio $D_{OUT}$ of the $I_H$ duty pulse. Therefore, the higher the cooling water temperature $T_W$ is, the higher the initial value of the heater current becomes, and the sooner the maximum limit of the heater current (100%) is reached.

Figure 7:
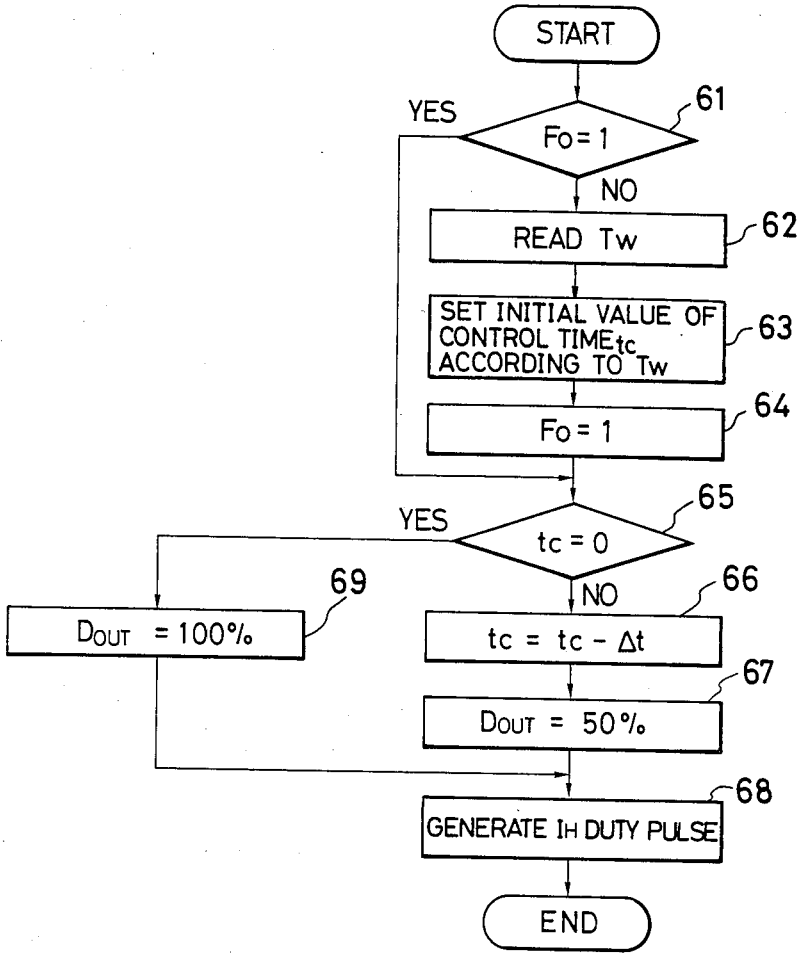
FIG. 7 is a flow chart showing the steps of another embodiment of the control method according to the present invention.

Turning to FIG. 7, another example of the control method of the oxygen concentration detection apparatus according to the present invention will be explained.

In the steps shown in FIG. 7, the air/fuel ratio control circuit 32 detects whether or not the initial value set flag Fo is equal to "1" at predetermined time intervals, after the closure of the ignition switch 34, at a step 61. Like the previous example, the value "0" is set for the initial value set flag Fo upon closure of the ignition switch 34. If Fo=0, it means that an initial setting of a control time tc for decreasing the duty ratio $D_{OUT}$ of the $I_H$ duty pulse is not completed, and the air/fuel ratio control circuit 32 reads in the cooling water temperature $T_W$ at a step 62. Then an initial value of the control time tc corresponding to the read value of the cooling water temperature $T_W$ is set at a step 63. In an internal memory of the air/fuel ratio control circuit 32, various values of the initial value of the control time tc, determined by the cooling water temperature $T_W$, are stored in the form of a data map as in the previous example. Therefore, the control circuit 32 searches an initial value corresponding to the read value of the cooling water temperature $T_W$ from the data map. The initial values of the control time tc are determined in such a manner that the value becomes smaller as the cooling water temperature $T_W$ rises. After the set of the initial value of the control time tc, a value "1" is set for an initial value set flag Fo, at a step 64. Then, whether or not the control time tc is equal to 0 (zero) is detected at a step 65. If $tc \neq 0$, it is determined that the time period corresponding to the initial value of the control time tc has not passed after the start of the supply of the heater current. In this case, the predetermined value $\Delta t$ is subtracted from the control time tc, and a result of the calculation is set as a new control time tc at a step 66. Then the duty pulse $D_{OUT}$ of the $I_H$ duty pulse is set at 50% at a step 67, and the $I_H$ duty pulse is supplied to the heater current supply circuit 36 at a step 68. If, on the other hand, tc=0, it means that the time peirod tc has pased from the start of the supply of the heater current. Therefore, the duty ratio $D_{OUT}$ of the $I_H$ duty pulse is set at 100% at a step 69. The $I_H$ duty pulse is then supplied to the heater current supply circuit 36 at the step 68.

On the other hand, if the content of the flag Fo is detected to be equal to 1 (Fo=1) at the step 61, the operation of the step 65 is executed immediately.

Figure 8:
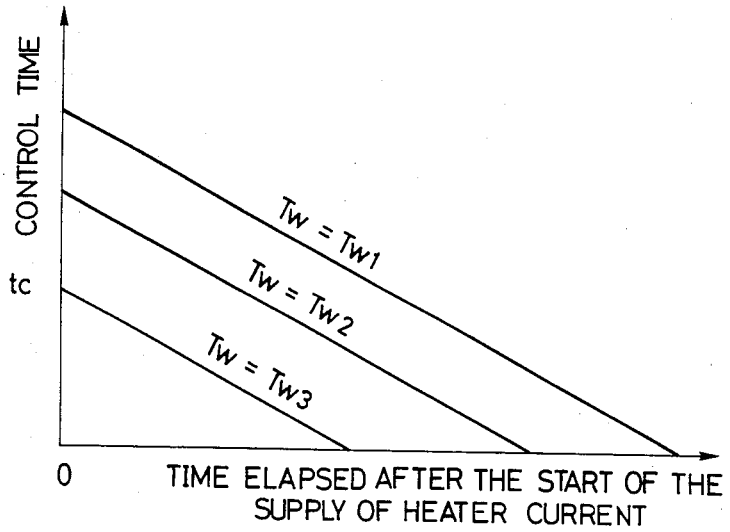
FIG. 8 is a diagram showing a variation of a control time tc immediately after the start of the supply of the heater current.

Thus, in this control method according to the present invention, the duty ratio $D_{OUT}$ of the $I_H$ duty pulse is set at 50% for a time period tc which is initially set in response to the cooling water temperature $T_W$ after the closure of the ignition switch 34. In other words, the magnitude of the heater currents flowing through the heater elememts 19 and 20 is proportional to the duty ratio $D_{OUT}$ of the $I_H$ duty pulse and reduced by half during the control time tc. As shown in FIG. 8, the higher the cooling water temperature $T_W$ ($T_{W1}<T_{W2}<T_{W3}$) at the time of the closure of the ignition switch 34, the shorter the control time tc. Thus, the duty ratio of 100% (corrsponding to the maximum level of the heater current) is reached faster as the cooling water temperature rises.

In the above described embodiments of the present invention, initial value of the duty ratio $D_{OUT}$ of the $I_H$ duty pulse or the initial value of the control time tc is determined according to the cooling water temperature $T_W$ at the time of the closure of the ignition switch. However, control method is not limited to the above example, and the initial values can be determined according to the intake air temperature, for example.

Figure 9:
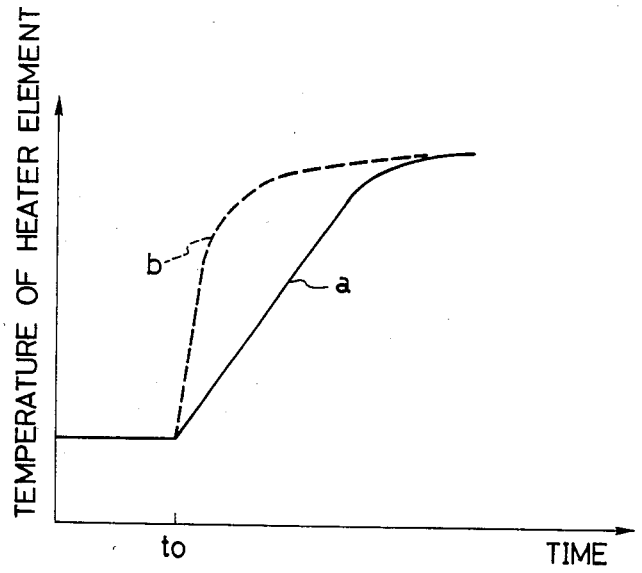
FIG. 9 is a diagram showing a variation of the temperature of the heater element immediately after the start of the supply of the heater current.
Figure 10:
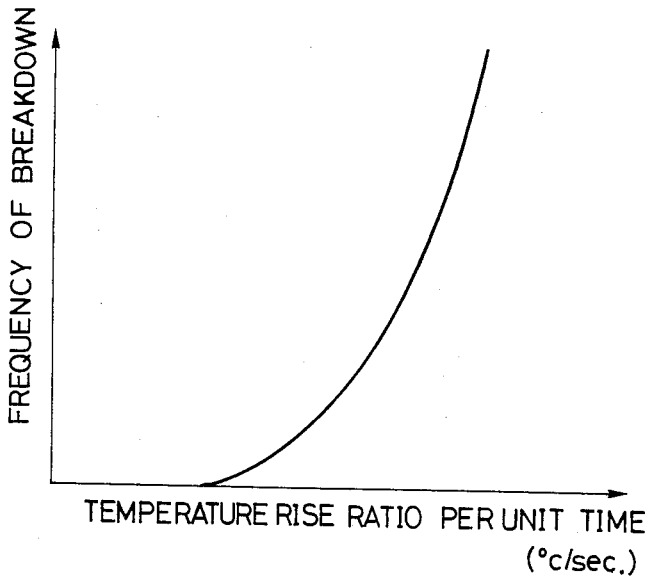
FIG. 10 is a diagram showing a relation between the frequency of the breakdown of the oxygen concentration detection element with respect to a rate of the temperature rise.

It will be appreciated from the foregoing, the method for controlling an oxygen concentration detecting apparatus according to the present invention is operative to detect the temperature of the engine immediately before the start of the supply of the current to the heater elements. From the start of the current supply until a time period corresponding to the detected engine temperature has elapsed, the magnitude of the currents supplied to the heater elements is reduced to be lower than the current value after the elapse of such a time period. Therefore, the rush current which flows through the heater element immediately after the start of the current supply can be reduced as compared with conventional arrangements. Thus, rapid deterioration of the heater element or a wire breaking in the heater element is prevented. This results in that the longevity of the oxygen concentration detection apparatus as a whole can be extended. FIG. 9 illustrates the temperature rise of the heater element after the time $t_0$ of the start of the supply of the heater current. As shown by the solid line a, the heater current increases more slowly by the method according to the present invention than a conventional arrangement which is shown by the dashed line b. Similarly, FIG. 10 shows the frequency of breakdown of the heater element with respect to the temperature rise per unit time. As shown by the curve of FIG. 10, the frequency of the breakdown becomes smaller as the temperature rise per unit reduces. Therefore, by controlling the temperature rise of the oxygen concentration detecting unit to be moderate, the possibility of the breakdown of the oxygen concentration detection unit can be greatly reduced.

What is claimed is:

1. A method for controlling an oxygen concentration detection apparatus of an internal combustion engine having an exhaust gas passage, which apparatus includes an oxygen concentration sensing element provided in said exhaust gas passage and producing an output signal representing an oxygen concentration in an exhaust gas of the engine and a heater element connected to said oxygen concentration sensing element and operative to heat said oxygen concentration sensing element when a heater current is supplied thereto, the method comprising:

a detection step for detecting a temperature of the engine immediately before a start of a supply of said heater current; and a control step for controlling a magnitude of said heater current from the start of the supply of said heater current, for a time period which is determined correspondingly to said temperature of the engine detected by said detection step, to be lower than a magnitude of the heater current after an elapse of said time period.

2. A method as set forth in claim 1, wherein said control step comprises:

an initial value setting step for setting an initial value of said heater current corresponding to said temperature of the engine immediately before the start of the supply of the heater current; and a step for gradually increasing the magnitude of the heater current supplied to the heater element, from said initial value to said magnitude of the heater current after the elapse of said time period, after a start of the engine.

* * * * *